United States Patent [19]

Solf et al.

[11] 4,236,476

[45] Dec. 2, 1980

[54] ARTICULATE MAST FOOTING ARRANGEMENT, IN PARTICULAR FOR WIND SURFBOARDS

[75] Inventors: Alexander Solf, Westfalenweg 330, 5600 Wuppertal 1, Fed. Rep. of Germany; Christian Mrozek, Karlsruhe, Fed. Rep. of Germany

[73] Assignee: Alexander Solf, Wuppertal, Fed. Rep. of Germany

[21] Appl. No.: 863,691

[22] Filed: Dec. 23, 1977

[30] Foreign Application Priority Data

| | | | |
|---|---|---|---|
| Dec. 23, 1976 | [DE] | Fed. Rep. of Germany | 2658414 |
| Oct. 13, 1977 | [DE] | Fed. Rep. of Germany | 2746095 |
| Dec. 13, 1977 | [DE] | Fed. Rep. of Germany | 2755429 |

[51] Int. Cl.[2] ..... B63B 15/00

[52] U.S. Cl. ..... 114/91; 9/310 E; 114/39

[58] Field of Search ..... 403/141, 142, 76, 77; 114/90, 91, 39; 115/34 R; 9/310 E

[56] References Cited

U.S. PATENT DOCUMENTS

| | | | |
|---|---|---|---|
| 1,779,057 | 10/1930 | Tolmach | 403/142 X |
| 2,674,501 | 4/1954 | Biegler | 403/76 |
| 3,112,910 | 12/1963 | Bal | 403/141 X |
| 3,487,800 | 1/1970 | Schweitzer et al. | 114/91 |
| 3,919,964 | 11/1975 | Hagen | 115/34 R |

*Primary Examiner*—Sherman D. Basinger

*Attorney, Agent, or Firm*—Michael J. Striker

[57] ABSTRACT

A connecting arrangement for connecting two elements with one another, particularly a mast and a boat body of a wind surfboard comprises a male member connected with one of the elements, and a female member engageable with the male member with snap action and connected to another of the elements. At least one of the members connected with a respective one of the elements is rotatable within the horizontal plane. Preferably, this one member is rotatable within the range of 360°. The male member and the female member together form a spherical joint. The male member may include a bolt section and a sperical section connected therewith whereas the female member may include a bolt portion and a cup portion connection therewith and adapted to receive the spherical section of the male member therein.

3 Claims, 8 Drawing Figures

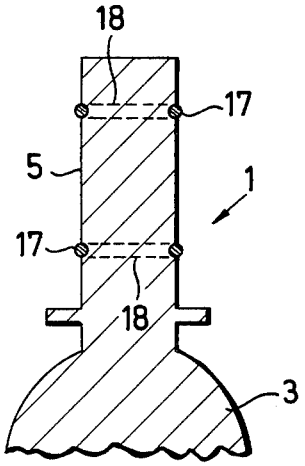
FIG.6
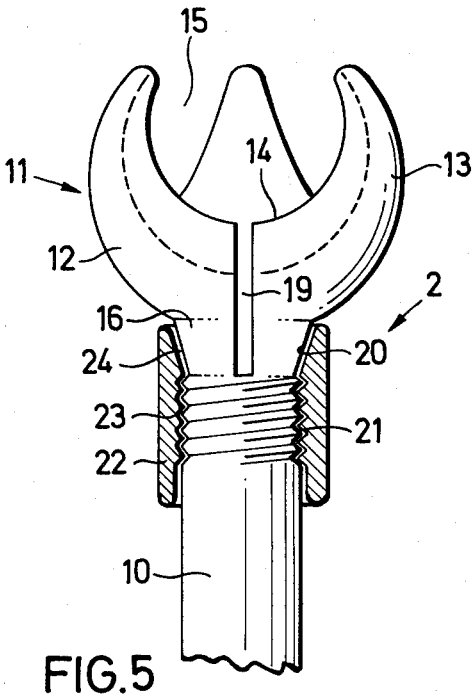
FIG.5
FIG.7
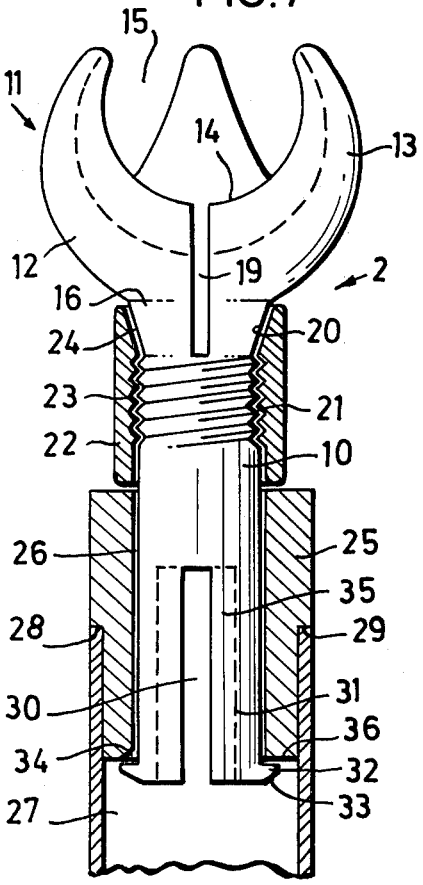

ARTICULATE MAST FOOTING ARRANGEMENT, IN PARTICULAR FOR WIND SURFBOARDS

BACKGROUND OF THE INVENTION

The invention relates to a mast footing arrangement devised in particular for wind surfboards and being configured in a spherical mode.

As a matter of rule, mast footing arrangements for wind surfboards consist of a joint. This joint has to enable the mast to be swingable to all sides over the water level and to be rotatable about its longitudinal axis. In addition, the mast ought to be swayable not only down to its horizontal plane position, but by several degrees more beyond it, so that the swinging angle must exceed 180°. This is needed due to the fact that the mast footing joint is arranged on the boat body above the water surface and the mast has to be tiltable usually down to the water level.

The hitherto known mast footing joints include a universal joint, which joint is configured so that the mast may be swung to all sides and is disposed rotarily. The universal or cross joints however are complexly built-up and require a considerable material expenditure. Moreover, they are work consumptive in manufacture and expensive in mounting. Besides, they involve high risk of injury, especially for the feet of the user of the surfboard.

Precisely for the latter indicated reason, there already have been proposed other solutions which have been reduced to practice. Thus, there has become known a joint providing a connection of the mast end to the vessel body and ensuring mobility to all sides. Here each of the components of the joint includes a plugging connector for the attachment of the mast and the components or the vessel body. The mast and the components or vessel body are interconnected by means of a central rubber band located in their interior. However, this joint is also constructionally complicated, in particular, since there is to be taken a precautional measure ensuring that the respective component for the body be strongly tied to the boat body and be reliably kept thereby.

Furthermore, there is known a spherical joint mast footing arrangement preventing further inclination of the mast in the vertical plane of the sail board after a certain inclination has been reached. For achieving this, a bolt on the joint is connected to the mast and is guided over a slanting arched path of a double-part shell that is unturnably affixed to the boat body. This notorious joint arrangement considerably reduces the mobility of the mast and encumbers the joint with a lever-like load in the area of the connection thereof, so that the mast footing of the board experiences a strong wear. Now, in addition to all of this, there is obtained a swaying capacity angle not exceeding 180°. Also, the mast could unintentedly surge at the highest section of the path curvature from the board thus ensuing a considerable peril of injury.

SUMMARY OF THE INVENTION

Accordingly, it is an object of the invention to provide a mast footing arrangement which avoids the disadvantages of the prior art.

More particularly, it is an object of the invention to provide a mast footing arrangement, which is unaffected by lever-like loading and which permits a swinging motion beyond 180°, as well as mast rotation over a full 360°, and in which any danger of injury is almost completely excluded. This arrangement is additionally easy to manufacture and mount, and also is produced with an advantage as concerns the costs.

In the mast footing arrangement of the kind alluded to in the introduction hereto, this problem is solved within the purview of this invention such that this novel mast footing arrangement is characterized in that it is formed by a pair of parts that are mutually assemblable by plugging. At least one part of this mast footing arrangement is lodged in the mast itself or in the boat body such that it is freely rotatable within the range of 360°. It is advantageous to have the portion of the joint associated to the boat body arranged to be rotatable in this boat body. In a specific embodiment of the invention, one part of the mast footing arrangement is configured as a ball-like body, preferably provided with a cylindrical bolt, while the other part consists in a cylindrical bolt carrying at its one end a spherically formed cup which latter includes at least three finger elements. In this case, it is particularly advantageous when this cup part is rotarily lodged in the boat body.

It has been established that this novel mast footing arrangement copes in an optimum manner with the requirements put in its regard. The same represents a security joint in which the transgressing of a certain pulling force causes that both the joint parts separate one from the other without any damaging effect in the way of their elastic snapping off. The same can thereafter be easily snapped together again. The limit pulling force and/or separating force depends on the elasticity of the cup fingers and can be correspondingly selected in advance by choosing an appropriate material therefor.

Another object of this invention is to construct the mast footing arrangement in a manner such that the separating force on the joint might be set up.

In the mast footing arrangement of the nature described, this object is solved in such a way that at least one finger element is arranged to be radially resettable. This is purposefully attained by providing an axially extending slot in the shell-like portion and/or in the root area of the cup, namely at least one such slot. Furthermore, at the outer side of the cup root, a conical annular surface is provided to run towards the cup, and this surface is threaded at the other side. Upon this treading, a nut is screwable which is configured in its region converted to the cup with an outwardly diverging annular surface, whose conical angle is preferably a little smaller than the conical angle of the conical annular surface on the cup root. It is particularly advantageous when a slit is provided at the side of each one of the fingers.

Though these provisions leave unchanged the radius of the spherical body and are surprisingly simple, they insure that the joint separation force is adjustable. It is self-speaking that it also is possible to slit the spherical body and to provide on the cylindrical bolt settable clamping means which in a special embodiment of the invention might be arranged on the cylindrical bolt of the cup member.

In effect of all of this, the here described invention makes possible in particular to achieve a strong attachment of the cylindrical bolt on the spherical portion to the boat body. According to a specific form of the execution of this invention, there is envisaged to provide the cylindrical bolt with a pair of mutually spaced elastic rings, either of which is embedded in a groove circumscribing the cylindrical bolt. In regard to the diameter of the bolt, the diameter of these rings is chosen to provide a coaction resulting in that, on insertion of the bolt into the therefor arranged opening in the boat body, a nearly air tight engagement is obtained. Although the joint and the mast sitting upon this joint can be slowly pulled out and detached, in case of an impulsive pulling force impact, a suction detaining force counteracts to prevent the mast footing from being suddenly torn out. It is thus essential that both of the sealing rings, which are made of an elastic material, maintain the cylindrical bolt in its opening duly centered and that they nearly totally eliminate any such displacement thereof.

In accordance with a specific embodiment of the invention, the shell portion and/or the root of the cup comprises at least one axially extending slot, that there is a conical annular surface outside the cup root diverging towards the cup and surrounded at its outer end with an adjacent threading and that there is a nut screwable onto this threading, which nut has further on the side facing the cup in its interior also a conical annular surface configured to diverge outwardly. The conical angle of this inner annular surface is preferably slightly smaller than the conical angle of the annular surface on the cup root.

It has appeared that this nut or similar screw means above or under the joint makes possible to fix a joint portion with a separable snap connector in the mast insertion piece.

Accordingly, the subject matter of this invention resides additionally in a mast footing arrangement equipped with a fixation means for one joint portion tied in the mast insertion piece.

BRIEF DESCRIPTION OF THE DRAWINGS

FIG. 5—a cross-sectional view of the cup portion;

FIG. 6—the spherical portion of the mast footing arrangement;

FIG. 7—the snapping closing means of one of the joint portions; and

DESCRIPTION OF PREFERRED EMBODIMENTS

Figure 1:
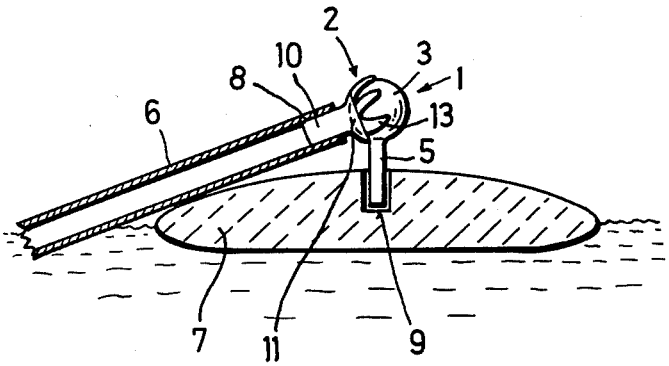
FIG. 1—the mast footing arrangement in sideview with cross-sectioned boat body.
Figure 3:
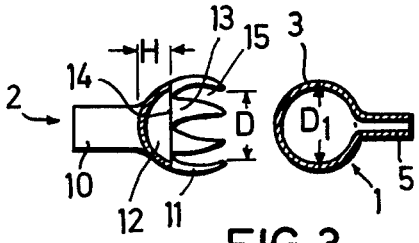
FIG. 3—a second variant of this arrangement.
Figure 2:
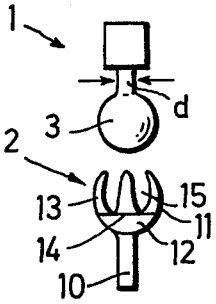
FIG. 2—a first variant of this arrangement.
Figure 4:
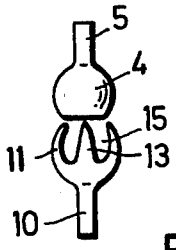
FIG. 4—a third variant of this arrangement.

The mast footing arrangement encompasses a pair of joint portions 1 and 2. The spherical portion 1 and the cup portion 2 are made preferably of a plastic material, in particular of polyethylene or polyamide. The spherical portion 1 comprises a cylindrical bolt 5 and a ball-like body 3, which latter may be configured as a hollow sphere or also as a ball body flattened on one pole thereof. In this second case, it is requirable that the diameter of the flattened surface be smaller than the radius. The bolt 5 has a length and a diameter almost that of the receptive opening 9 in the boat body 7, whereinto this bolt is to be inserted. This bolt carries in a spaced relationship a pair of elastic rings 17, either of which is embedded in a corresponding groove 18, while both the rings exceed the diameter of the bolt. Thereby, the bolt 5 of the spherical portion 1 can rotate relative to the boat body. The cup portion 2 is configurated as a hollow ball and has associated thereto a cylindrical bolt (10), at one end whereof a spherically configured cup 11 is located. This cup 11 consists of a shell part 12 and of finger elements 13. The finger elements 13 also may start from the root 16 of the cup. The form of the finger elements may be freely selected, but, preferably, these finger elements, observed from the side, converge conically toward the apex and are formed with rounded free terminals. Their length is devised so that they transgress the equator of the spherical cup. The top opening diameter therebetween is smaller than the outer diameter of the sphere, but is larger than the diameter of the cylindrical bolt 5 of the spherical portion 1. It is preferable to have arranged three fingers of this kind, disposed in star-like mode at angles of about 120°. Quite naturally, there also could be provided more peripherally disposed fingers. Necessarily, the intermediate space 15 between the adjacent finger elements 13 must be dimensioned so that the bolt 5 of the spherical portion 1 can have a free access in this intermediate space 15 down to the shell portion border 14. In consideration of this requirement, the intermediate space 15 ought to correspond at least to the diameter of the cylindrical bolt 5 of the spherical portion 1. The height of the shell portion depends on the desired angle of the swaying capacity. However, the same is lower than that of a semi-spherical shell. The border 14 is limitative of the angle of the possible swaying declination of the mast.

It also is important that the diameter of the bolt 5 be chosen so that this bolt, on being tilted, comes first in contact with the border 14, when it has reached the desired inclination angle. For this reason, the bolt diameter and the shell height are to be correspondingly correlated. In a construction where no shell part is provided and the fingers, especially when they are three, depart from the cup root, there can be selected a particularly large diameter for the bolt.

According to one exemplary embodiment of the invention, the space between the finger elements 13 radially decreases in a manner such that there is provided sidewardly of each finger element a slot 19 axially running toward the bolt 10, so that the finger elements are enabled to be elastically moved to one another by action of a suitable resetting means. In one preferable embodiment, this resetting means consists in a conic annular surface 20 interconnecting the root 16 to the bolt 10 and in a treading 21 joining the mentioned conical annular surface. Upon this treading 21, a nut 22 with a threading 23 may be screwed which nut is provided in its region facing the cup with a conical annular surface 24. The conicity angle of this annular surface 24 is slightly smaller than the conicity angle of the annular surface 20. Accordingly, when the nut is screwed on the threading, the conical annular surface 24 abuts the conical annular surface 20 and, when its screwing is continued, the same provokes a closing motion of the cup as an effect of the narrowing of the slots 19. Notwithstanding the surprisingly simplicity of this provision, the same ensures that there is achieved a narrowing of the cup opening with the result that also the separating force becomes increased, namely the force needed for extracting the spherical body 3 from the cup.

It is essential that the fingers be enabled to withstand the forces being transferred at the mast foot and that they be elastic enough to permit that the cup portion 2 be shifted over the spherical portion 3 in which operation the cup opening 15 becomes elastically enlarged. When now the joint is in its inserted assembled condition, the fingers on the cup portion closingly and firmly embrace the spherical portion and maintain it in position like a solid seat.

Figure 8:
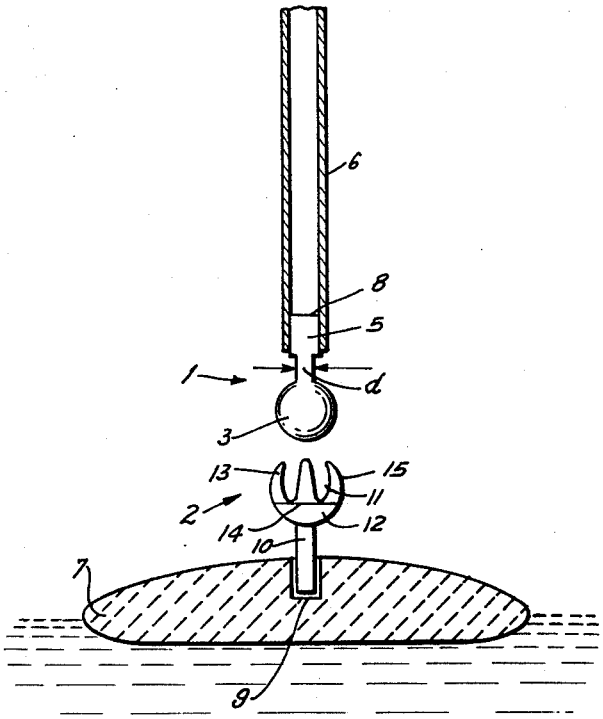
FIG. 8—a fourth variant of the arrangement.

It is possible that the spherical portion 1 be connected to the mast, whereas the cup portion 2 be connected to the boat body as shown in FIG. 8.

The mast footing arrangement brought in by the invention makes possible to have tied one portion of the joint firmly and the other portion of this joint rotarily to the boat body or to the mast, or to have both the portions lodged turnably in the mast and the boat body. The rotatable connection of one or both portions of the joint to the boat body and/or to the mast may be performed as shown in FIG. 6, e.g. by means of the rings 17 embedded in the grooves 18. The insertion of the joint may be performed after tackeling of the boat.

In this way, the invention provides a specifically simply constructed joint for the mast footing arrangement, where both the parts of the joint may be produced as plastic material injection or press formed parts. In this case, the swaying capacity proves to be at the optimum and in addition thereto, the mast may be attached so as to be rotatable.

It is self-speaking that it also is possible to have at least one portion of the joint equipped instead of the bolt with a per-se known bridging member and to have the same engaged in a corresponding cavity in the mast or in the boat body. Also the rounded areas of the joint of this invention exclude any danger of injury.

The fixation arrangement according to this invention reposes on the nut 22 and on the treadings 21 and 23. At the end of the bolt 10, there is engaged therewith a per-se known cylindrical mast attachment piece 25 provided with a bore 26 conformed to the bolt 10 and with an annular abutting edge 28. The mast attachment piece is introduced into the hollow region 27, so that the terminal edge 29 of the mast 27 abuts the abutting edge 28.

The mast and the mast attachment piece are connected to one another for having the joint inseparably tied to the mast, in order to attain a firmly unifying hold of the entire mast footing arrangement.

There are many cases in which it will be purposeful to free the joint quickly from the mast attachment piece, namely also, when the latter sticks to the mast. According to the invention, for achieving this, the terminal section of the bolt 10 is cut to form at least one slot 30 extending axially, thus being formed bolt tines 31 which are provided with border flanges 32 reaching beyond the bore 26. Preferably, the border flanges 32 possess outer bevellings 33, while the inner edge of the mast attachment piece 25 adjacent the border flanges 32 is provided with a corresponding bevelling 34 too. Furthermore, it is advantageous for the biasing operation of the bolt tines 31 when the bolt 10 includes a bore 35.

The function of the fixation arrangement provided by this invention is as follows:

For the mounting assemblage, the bolt 10 carrying on the nut 22 is inserted into the bore 26 of the mast attachment piece 25. During this operation, the biasing bolt tines 31 are radially depressed inwardly. This may be done manually or is produced thanks to the bevelling 33, whose inner edge is for this purpose preferably positioned within the range of the annular opening of the bore 26, so that the edge of the bore 26 can slide on the bevelling 33 and is enabled so to radially press together the bolt tines 31. On being introduced, the bolt tines 31 tend to bias back to their starting positions, when the border flange 32 arrives beyond the bore 26. The operative conditions are chosen so that this snapped connection either absolutely can not or hardly can be effectively disengaged manually. For this reason, there is the nut 22 which is serviceable for the separation. The same is turned and thus exerts pressure onto the mast attachment piece 25 which then impacts the entrance surface 36 and forces it against the border flange 32. In effect hereof the bolt tines 31 are radially moved due to a levering actuation, so that the outer edge of the border flange 32 slides in its lower area along the inner edge of the annular surface 34 and the joint tines 31 become elastically shifted radially to one another and the border flange 32 glides into the bore 26. This operation is substantially eased by a slight bevelling 34 on the mast attachment piece 25. All this led to the achievement that under application of few means there is obtained an efficient snapping interconnection that can not be manually disengaged, but can be provided by actuation of the nut 22 capable of exerting a substantially greater force apt to provide this disengagement.

It will be understood that each of the elements described above, or two or more together, may also find a useful application in other types of constructions differing from the types described above.

While the invention has been illustrated and described as embodied in an articulate mast footing arrangement, it is not intended to be limited to the details shown since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A connecting arrangement for connecting two elements with one another, particularly a mast and a boat body of a wind surfboard, comprising a male member connected with one of the elements and having a spherical section and a cylindrical bolt carrying said spherical section; a female member connected to another of the elements and having a cup portion which includes a shell section and a plurality of fingers extending from said shell section and receives and engages said spherical section of said male member only by snap action so that said spherical section of said male member is retained in but rotatable relative to said cup portion of said female member, at least one of said members connected with a respective one of the elements being rotatable within a horizontal plane; and means for rotatably connecting said one member with said respective one of said elements, including two grooves formed in said bolt of said male member and two resiliently yieldable rings engaged in said grooves and extending outwardly beyond an outer surface of said bolt.

2. A connecting arrangement for connecting two elements with one another, particularly a mast and a boat body of a wind surfboard, comprising a male member connected with one of the elements and having a spherical section; and a female member connected to another of the elements and having a cup portion which includes a shell section and a plurality of fingers extending from said shell section and receives and engages said spherical section of said male member only by snap action so that said spherical section of said male member is retained in but rotatable relative to said cup portion of said female member, at least one of said members connected with a respective one of the elements being rotatable within a horizontal plane, and at least one of said fingers being radially adjustable; means for radially adjusting said one finger, said adjusting means including an axially open slot and a first conical surface formed an said female member, and an adjusting member having a second conical surface adapted to cooperate with said first conical surface so as to compress said female member by this cooperation and to thereby radially displace said one finger, said first conical surface diverging toward said cup portion of said female member and having two axial ends, said cup portion of said female member being located at one of said axial ends of said first conical surface, said adjusting means further including a first thread formed on said female member at another of said axial ends of said first conical surface and a second thread formed in said adjusting member and meshing with said first thread of said female member so that by cooperation of said threads said adjusting member and said second conical surface are pulled onto said female member and onto said first conical surface thereof, respectively, the other of said elements having an opening, a bolt on said female member having two axial end portions, and said first thread being formed on one of said axial portions of said bolt of said female member; and means for connecting said female member to said other element including at least one slot provided in another of said axial end portions of said bolt of said female member and extending in a direction of elongation thereof so as to form resiliently deformable sections receivable in said opening of said other element.

3. A connecting arrangement for connecting together a mast element and a surfboard element of a wind surfboard, comprising a male member connected with one of the elements and having a spherical section, and a bolt which has a longitudinal axis and supports said spherical section; and a female member connected to the other element and having a cup portion with a shell section and a plurality of fingers extending from said shell section so as to form a plurality of gaps therebetween, and a further bolt which has a further longitudinal axis and supports said cup portion, said cup portion being rotatable about said further longitudinal axis relative to the other element and arranged to receive and engage said spherical section of said male member only by snap action, so that said spherical section of said male member is retained in but freely rotatable relative to said cup portion of said female member about said first-mentioned longitudinal axis, one of said members being swingable relative to the other of said member to such an extent that said first-mentioned bolt of said male member can engage into one of said gaps of said cup portion of said female member, said fingers having pointed tips, whereby to facilitate entry of the bolt of said male member into the gap between adjoining fingers of said rotatable cup portion.

* * * * *